US010069242B1

(12) United States Patent
Wen

(10) Patent No.: US 10,069,242 B1
(45) Date of Patent: Sep. 4, 2018

(54) FALLING-OFF PREVENTION STRUCTURE OF A NETWORK CABLE PLUG

(71) Applicant: Chin-Hsing Wen, Taoyuan (TW)

(72) Inventor: Chin-Hsing Wen, Taoyuan (TW)

( * ) Notice: Subject to any disclaimer, the term of this patent is extended or adjusted under 35 U.S.C. 154(b) by 0 days.

(21) Appl. No.: 15/798,469

(22) Filed: Oct. 31, 2017

(30) Foreign Application Priority Data

Jul. 7, 2017 (TW) ..... 106209983 U

(51) Int. Cl.
*H01R 13/627* (2006.01)
*H01R 13/633* (2006.01)
*H01R 43/26* (2006.01)

(52) U.S. Cl.
CPC ..... *H01R 13/6275* (2013.01); *H01R 13/6335* (2013.01); *H01R 13/627* (2013.01); *H01R 43/26* (2013.01)

(58) Field of Classification Search
CPC .. H01R 43/26; H01R 13/6272; H01R 13/633; H01R 13/6335
See application file for complete search history.

(56) References Cited

U.S. PATENT DOCUMENTS 5,505,638 A * 4/1996 Su ..... H01R 24/62 439/374
7,892,012 B1 * 2/2011 Foung ..... H01R 13/6272 439/344
8,556,645 B2 * 10/2013 Crain ..... H01R 13/633 438/258
8,632,352 B2 * 1/2014 Wagner ..... H01R 13/6397 439/352
8,678,699 B2 * 3/2014 Maguire ..... B62J 7/00 224/431
8,747,141 B2 * 6/2014 Crain ..... H01R 13/6272 439/258
8,845,344 B2 * 9/2014 Ishiyama ..... H01R 43/26 439/133
9,048,580 B2 * 6/2015 Chien ..... H01R 13/6272

FOREIGN PATENT DOCUMENTS

TW M529298 U 9/2016

* cited by examiner

*Primary Examiner* — Briggitte R Hammond
(74) *Attorney, Agent, or Firm* — Alan D. Kamrath; Kamrath IP Lawfirm, P.A.

(57) ABSTRACT

A network cable plug with a falling-off prevention structure includes a plug body (1), a connecting sleeve (2), and a stopper plate (3). The plug body (1) is inserted into a network socket (6). The connecting sleeve (2) is connected to the plug body (1). The stopper plate (3) can be inserted into the connecting sleeve (2) to a locking position. In the locking position, a stopper portion (31) of the stopper plate (3) is located below and abuts an elastic clip (13) to prevent the elastic clip (13) from being pressed downward, and a bottom protrusive portion (33) of the stopper plate (3) is engaged in a fixing hole (25) of the connecting sleeve (2). The stopper plate (3) is bendable upward to disengage the bottom protrusive portion (33) from the fixing hole (25), permitting the stopper plate (3) to move rearward to disengage from the elastic clip (13).

3 Claims, 10 Drawing Sheets

FALLING-OFF PREVENTION STRUCTURE OF A NETWORK CABLE PLUG

CROSS REFERENCE TO RELATED APPLICATION

This application claims the benefit of priority from Taiwan Patent Application No. 106209983, filed Jul. 7, 2017, the entire contents of which are incorporated herein by reference.

BACKGROUND OF THE INVENTION

The present invention relates to a falling-off prevention structure of a network cable plug and, more particularly, to a network cable plug including a falling off-prevention structure for preventing the network cable plug coupled with a network socket from falling off due to unintentional pressing.

A conventional network cable plug generally includes an insulating body, a plurality of terminals embedded in a front end of the insulating body, an elastic clip-formed on a top side of the insulating body and extending outward, and a protective cover having a semi-circular pressing portion. A network cable can be connected via the network cable plug to a network socket of a computer or network equipment. The elastic clip is coupled with the network socket to prevent the network cable plug from falling off.

The protecting cover of the above network cable plug uses the pressing portion abutting the elastic clip, permitting easy pressing of the elastic clip for removing the network cable plug. However, the pressing portion of the protective cover is apt to be pressed or touched inadvertently and, thus, leads to falling off or incomplete contact of the network cable plug, resulting in unstable transmission and interruption of data transmission. This causes inconvenience and trouble to the user during use. In Taiwan Utility Model No. M529298 filed by Applicant of the present invention and entitled "FALLING-OFF PREVENTION ELECTRICAL CONNECTOR", a latching element is inserted into a protecting cover of a network and abuts a bottom side of an elastic clip. Thus, a pressing plate and the elastic clip cannot be pressed, preventing the network cable plug from disengaging from a socket and thereby preventing inadvertent falling off or poor contact of the network cable plug. On the other hand, when it is desired to unplug the network cable plug, a specific unlatching member is required to disengage the latching member from the bottom side of the elastic clip to permit pressing of the pressing portion of the pressing plate and the elastic clip for subsequent removal of the network cable plug. However, the unlocking procedure by the unlatching element is troublesome and time-consuming. Furthermore, unlocking cannot proceed if the unlatching member is lost. Improvement is, thus, required.

BRIEF SUMMARY OF THE INVENTION

The primary objective of the present invention is to provide a network cable plug including a stopper portion to prevent the elastic clip from being pressed downward, avoiding loosening, falling off, and poor contact of the network cable plug resulting from inadvertent pressing and touching. When it is desired to remove the network cable plug, the stopper plate is bent upward to rapidly achieve the unlocking operation without any tool. Thus, the network cable plug can be unlocked and removed more easily and more quickly.

To fulfill the above objective, the present invention provides a network cable plug with a falling-off prevention structure including a plug body having a front end and a rear end spaced from the front end in a longitudinal direction. The plug body includes an insertion end at the front end thereof. The insertion end is configured to be inserted into a network socket. The insertion end includes an upper side. An elastic clip projects from the upper side of the insertion end. The plug body further includes a connection end at the rear end thereof. A connecting sleeve includes a front end having a connecting portion. The connecting portion is connected to the connection end of the plug body. The connecting sleeve includes a shield disposed on a top side thereof. The shield includes a receiving space extending from a front end through a rear end of the shield. A fixing hole is defined in the top side of the connecting sleeve and intercommunicates with the receiving space. A stopper plate includes a plate body having a front end and a rear end. The plate body includes a stopper portion on the front end thereof and an operative portion on the rear end thereof. The plate body further includes a top protrusive portion disposed on a top side of the plate body and located between the stopper portion and the operative portion. The plate body further includes a bottom protrusive portion disposed on a bottom side of the plate body and located between the top protrusive portion and the operative portion. The stopper plate is inserted into the receiving space of the connecting sleeve and is movable between a locking position and an unlocking position behind the locking position in the longitudinal direction.

When the stopper plate is in the locking position, the stopper portion is located below and abuts the elastic clip to prevent the elastic clip from being pressed downward, the top protrusive portion is received in and abuts the shield, the bottom protrusive portion is engaged in the fixing hole, and the operative portion of the stopper plate is exposed behind the shield.

The stopper plate is bendable upward at a portion between the top protrusive portion and the bottom protrusive portion to disengage the bottom protrusive portion from the fixing hole, permitting the stopper plate to move rearward to the unlocking position disengaged from the elastic clip of the plug body.

In an example, the shield of the connecting sleeve includes a positioning groove at the rear end of the receiving space. The stopper plate further includes a positioning block disposed on the top side of the stopper plate and aligned with the bottom protrusive portion. The positioning block is received in the positioning groove when the stopper plate is in the locking position.

In an example, the stopper plate further includes a slot in front of the positioning block.

The present invention will become clearer in light of the following detailed description of illustrative embodiments of this invention described in connection with the drawings.

DETAILED DESCRIPTION OF THE INVENTION

Figure 1:
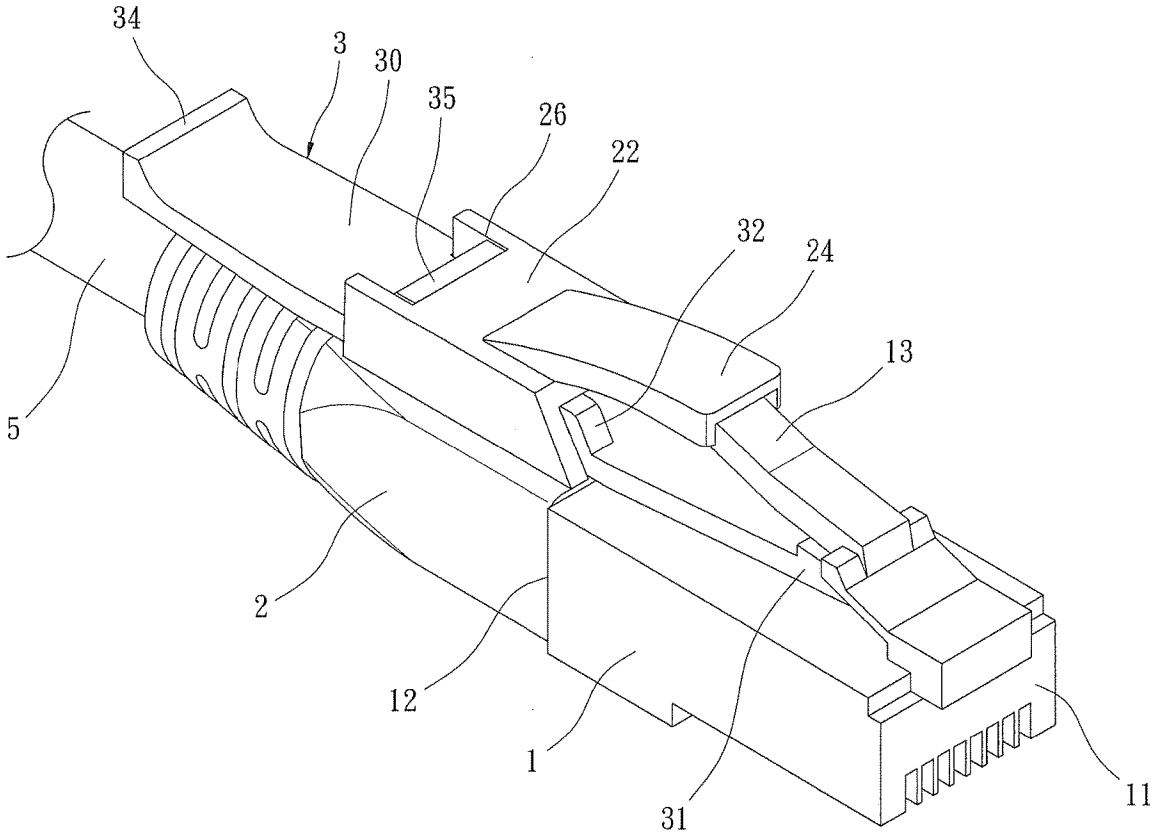
FIG. 1 is a partial, perspective view of a network cable including a network cable plug of an example according to the present invention.

With reference to FIGS. 1-5, a network cable plug with a falling-off prevention structure according to the present invention includes a plug body 1, a connecting sleeve 2, and a stopper plate 3. The plug body 1 receives a plurality of conductive pins 4 (FIG. 5) for electrical connection with wires 51 in a network cable 5.

Figure 5:
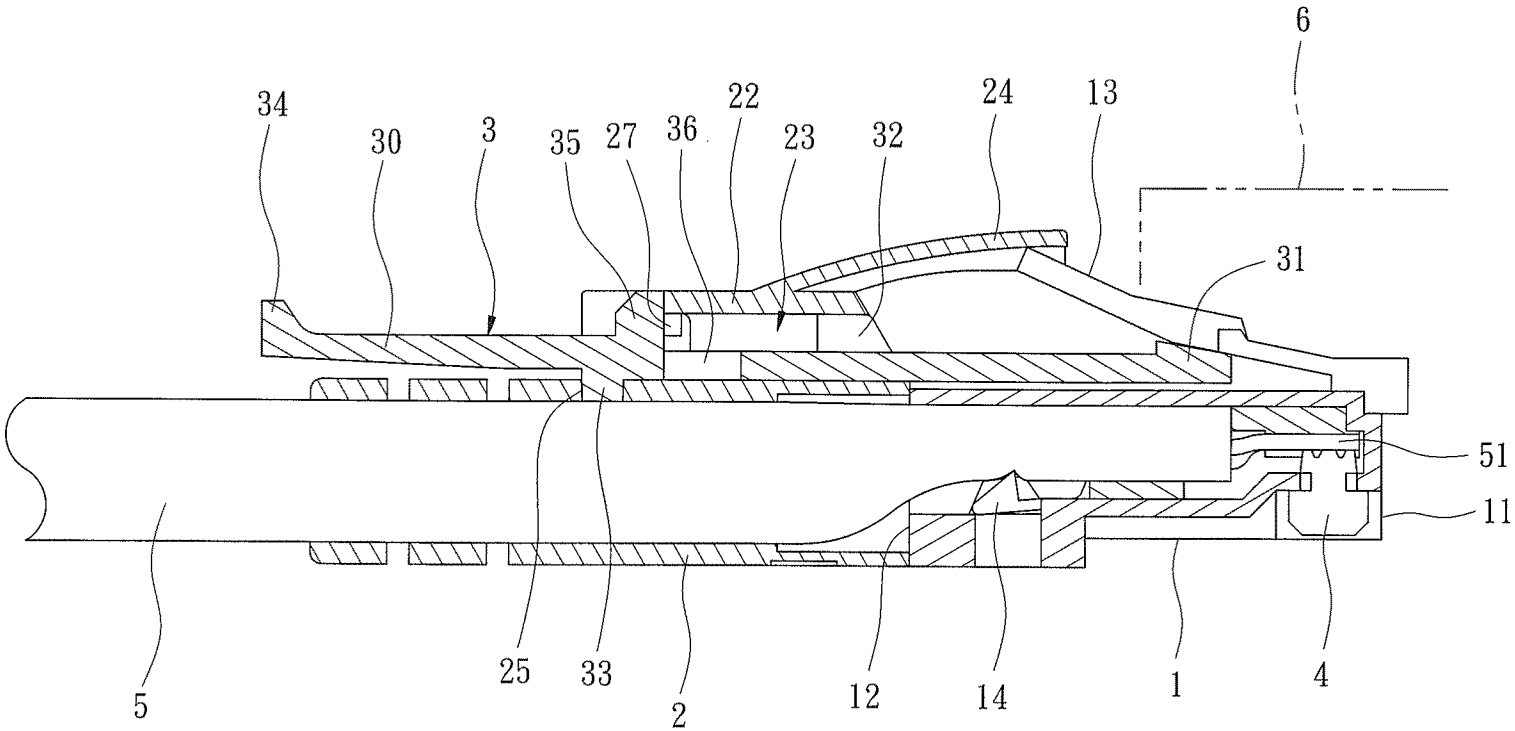
FIG. 5 is a cross sectional view of the network cable of FIG. 1, illustrating use of the network cable plug.

The plug body 1 includes a front end and a rear end spaced from the front end in a longitudinal direction. The plug body 1 includes an insertion end 11 at the front end thereof. The insertion end 11 is configured to be inserted into a network socket 6 (FIG. 5). An elastic clip 13 projects from and is at an acute angel to an upper side of the insertion end 11. The plug body 1 further includes a connection end 12 and a coupling block 14 at the rear end thereof (FIG. 5).

Figure 2:
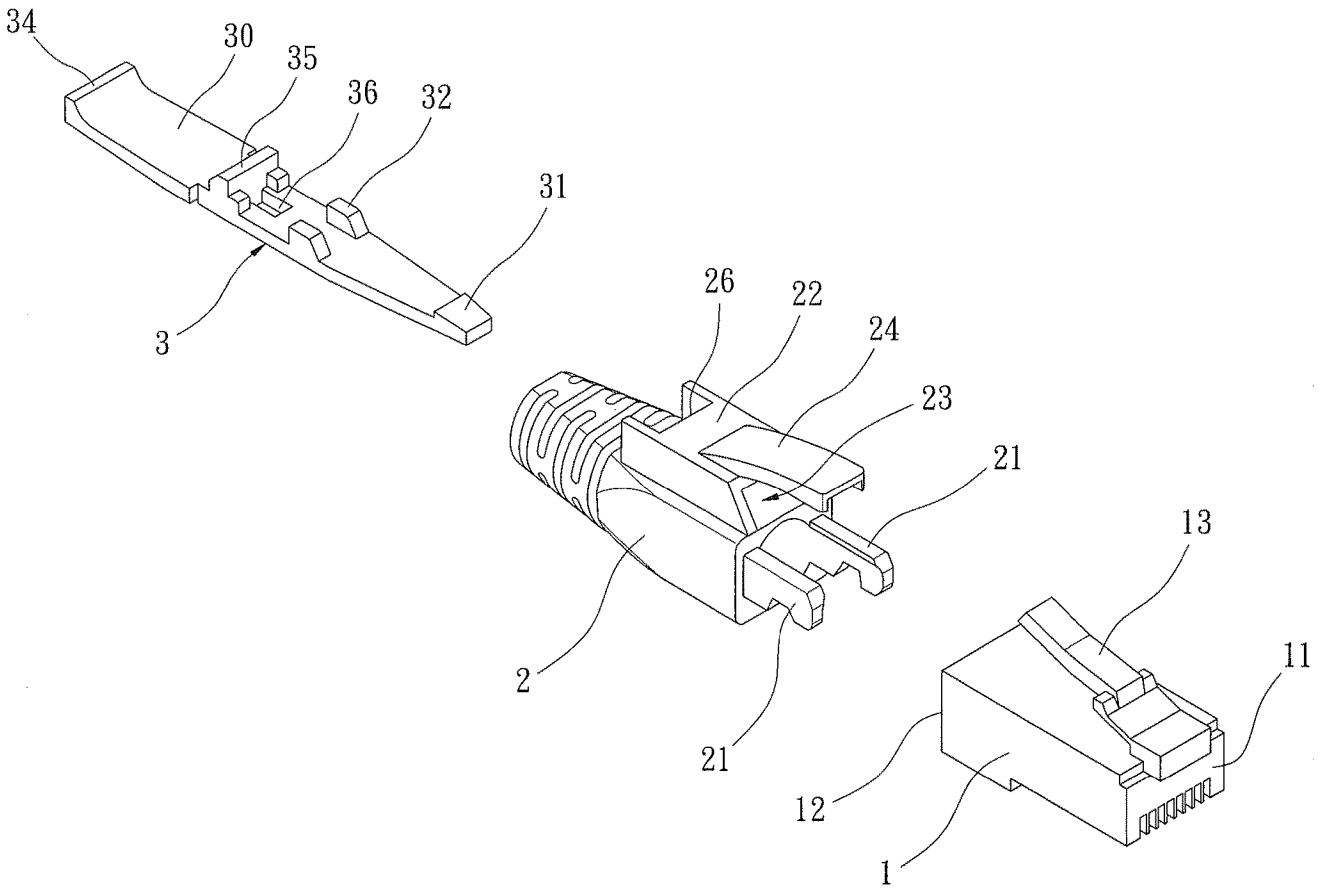
FIG. 2 is an exploded, perspective view of the network cable plug of FIG. 1.
Figure 3:
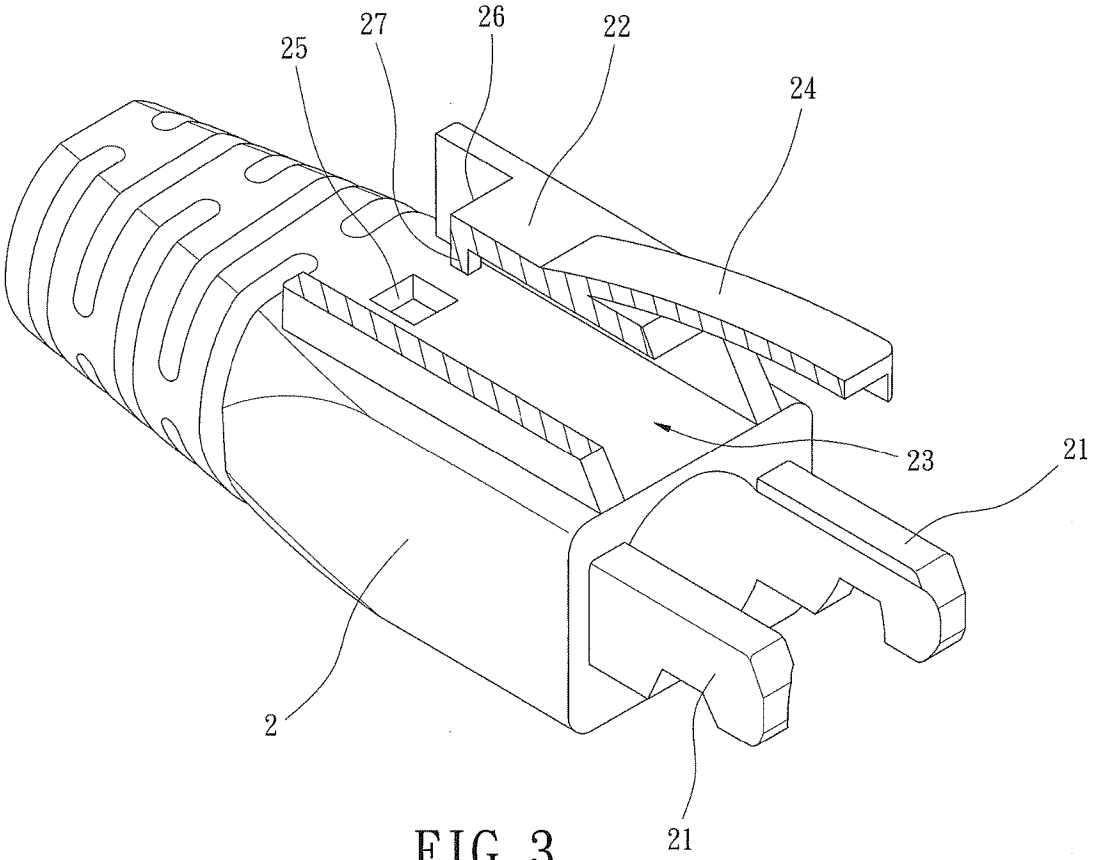
FIG. 3 is a perspective view of a portion of the network cable plug of FIG. 2, with a connecting sleeve partly cut away.
Figure 4:
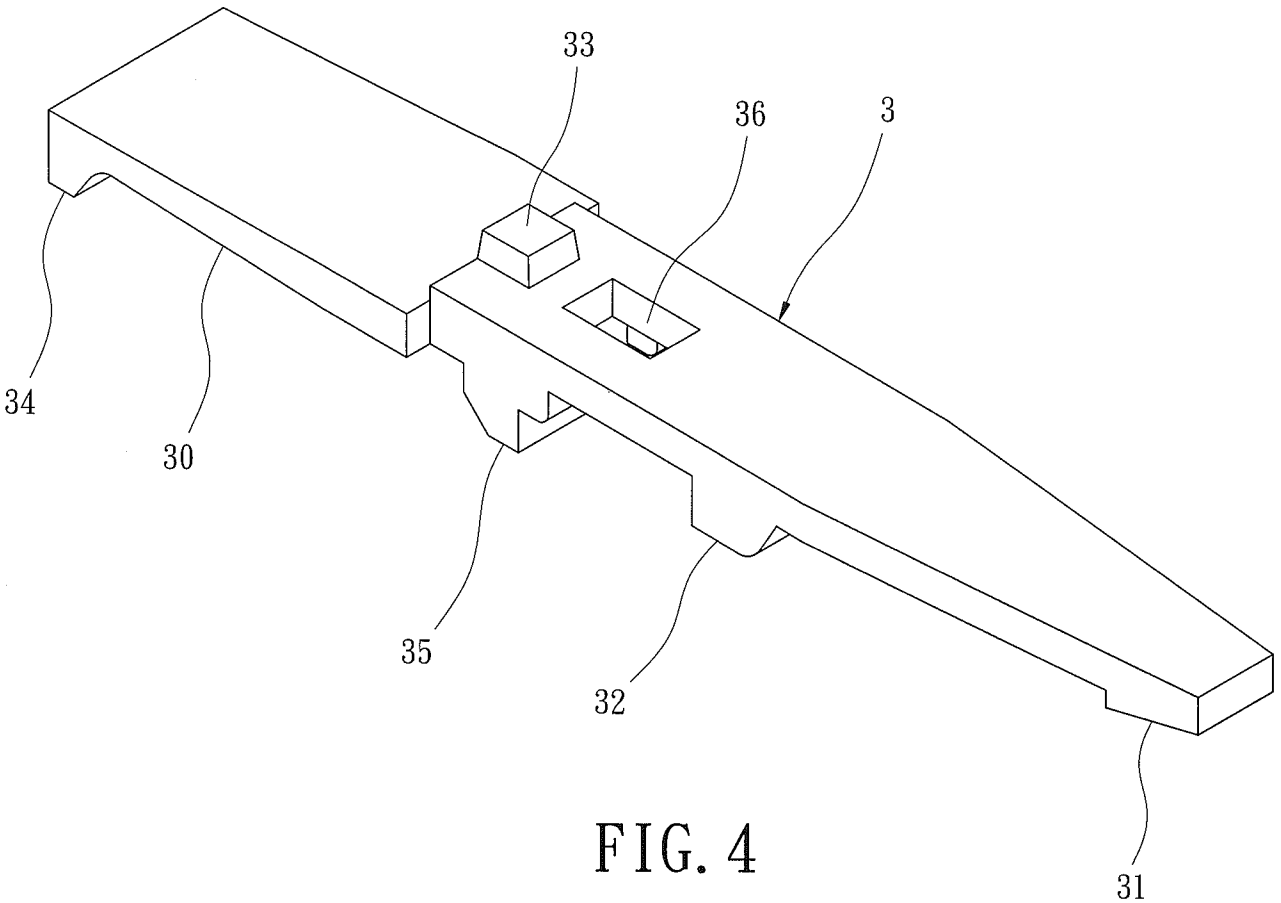
FIG. 4 is a perspective view of a stopper plate of the network cable plug of FIG. 2.

The connecting sleeve 2 includes a front end having a connecting portion 21 (FIG. 2). The connecting portion 21 is connected to the connection end 12 of the plug body 1 and can be coupled with the coupling block 14 for positioning purposes. The connecting sleeve 2 includes a shield 22 disposed on a top side thereof. The shield 22 includes a receiving space 23 extending from a front end through a rear end of the shield 22. The shield 22 further includes a rib 27 in the receiving space 23. A pressing portion 24 is disposed on the shield 22 and has an end rests on the elastic clip 13 of the plug body 1. The shield 22 of the connecting sleeve 2 further includes a positioning groove 26 at the rear end of the receiving space 23. Furthermore, a fixing hole 25 is defined in the top side of the connecting sleeve 2 and intercommunicates with the receiving space 23.

The stopper plate 3 includes a plate body 30 having a front end and a rear end. The plate body 30 can be elongated and can be made of plastic material. The plate body 30 includes a stopper portion 31 on the front end thereof and an operative portion 34 on the rear end thereof. A top protrusive portion 32 is disposed on a top side of the plate body 30 and is located between the stopper portion 31 and the operative portion 34. A bottom protrusive portion 33 is disposed on a bottom side of the plate body 30 and is located between the top protrusive portion 32 and the operative portion 34. Furthermore, a positioning block 35 is disposed on the top side of the stopper plate 3 and is aligned with the bottom protrusive portion 33. The stopper plate 3 further includes a slot 36 in front of the positioning block 35.

Figure 6:
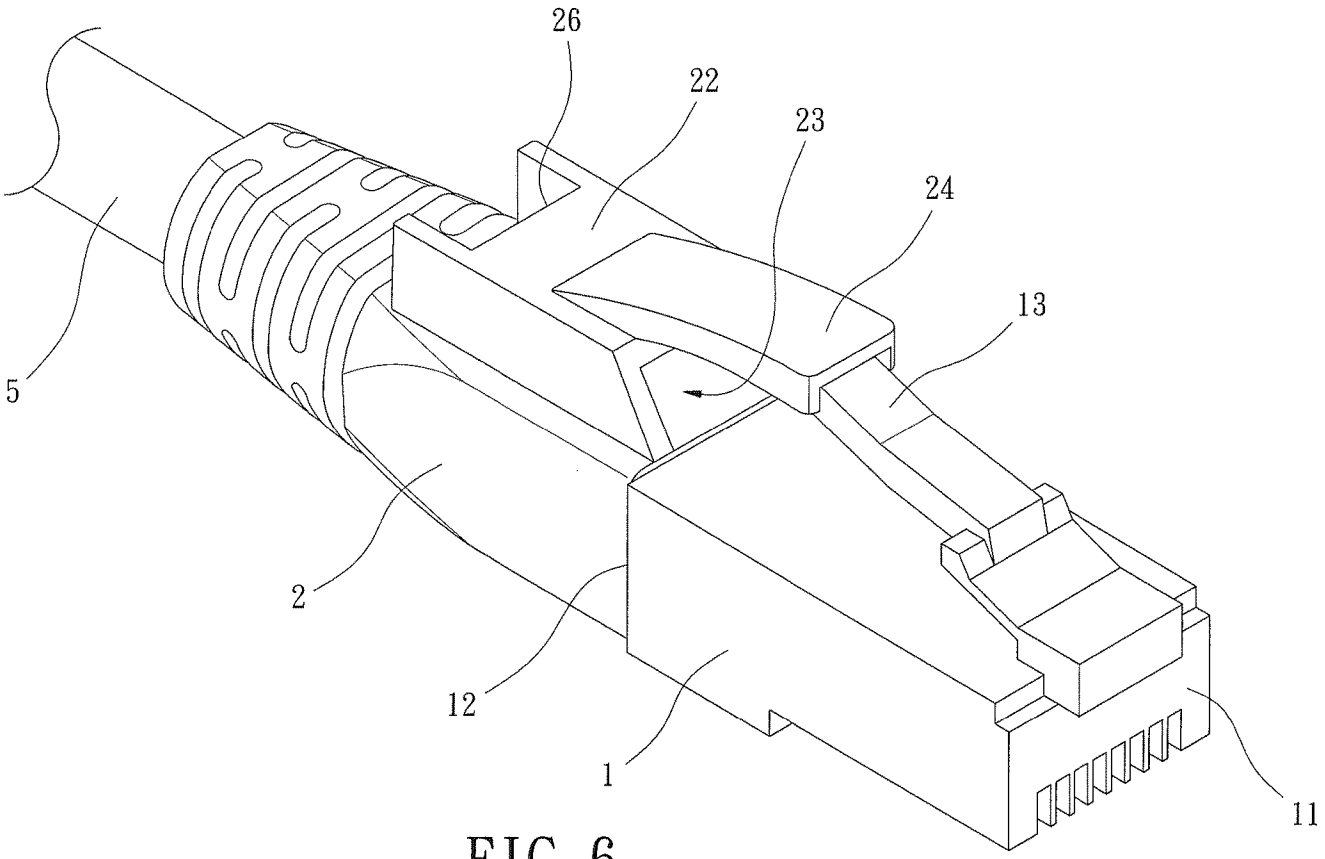
FIG. 6 is a perspective view of the network cable of FIG. 1 before a stopper plate is assembled.
Figure 7:
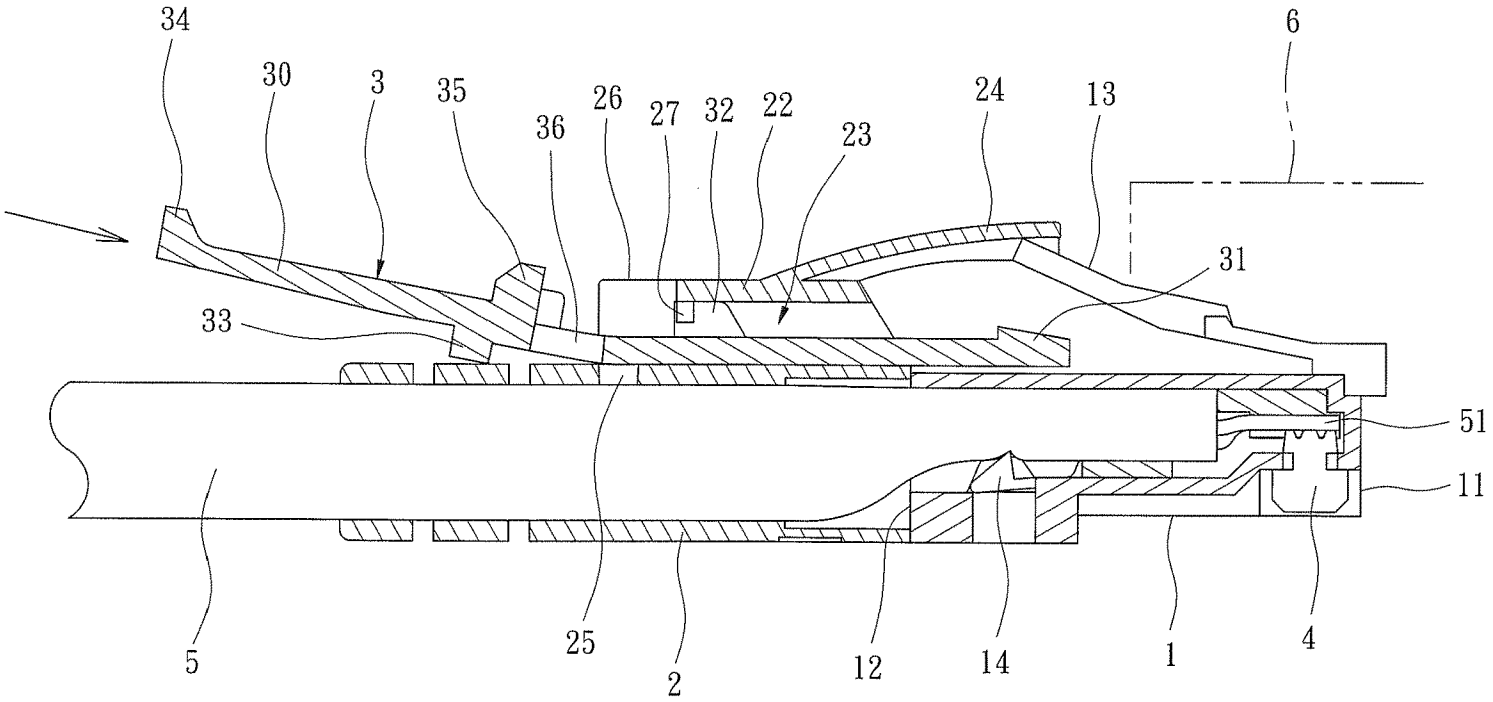
FIG. 7 is a cross sectional view illustrating assembly of the network cable plug.

In use of the network cable plug according to the present invention, as shown in FIGS. 6 and 7, the stopper plate 3 is inserted into the receiving space 23 of the connecting sleeve 2. The plug body 1 at the front end of the network cable plug is coupled in the network socket 6 of a computer or network equipment and is securely retained in the network socket 6 by the elastic clip 13.

To prevent the plug body 1 from being pulled of the network socket 6, a user can pushes the stopper plate 3 forward to a locking position, as shown in FIGS. 1 and 5, such that the stopper portion 31 is located below and abuts a bottom of the elastic clip 13 to prevent the elastic clip 13 from being pressed downward. Furthermore, the top protrusive portion 32 is received in and abuts the shield 22, the bottom protrusive portion 33 is engaged in the fixing hole 25, and a rear section including the operative portion 34 of the stopper plate 3 is exposed behind the shield 22. Furthermore, the positioning block 35 is received in the positioning groove 26 when the stopper plate 3 is in the locking position. Accordingly, the stopper plate 3 is reliably positioned in the connecting sleeve 2. Furthermore, the stopper portion 31 abuts the bottom of the elastic clip 13 to prevent the elastic clip 13 from being pressed downward, avoiding loosening, falling off, and poor contact of the network cable plug resulting from inadvertent pressing and touching. Furthermore, the stopper plate 3 can be of any desired color for easy identification and easy management by the color. Furthermore, the rear section of the stopper plate 3 can include a code number for easy identification and easy management.

Figure 8:
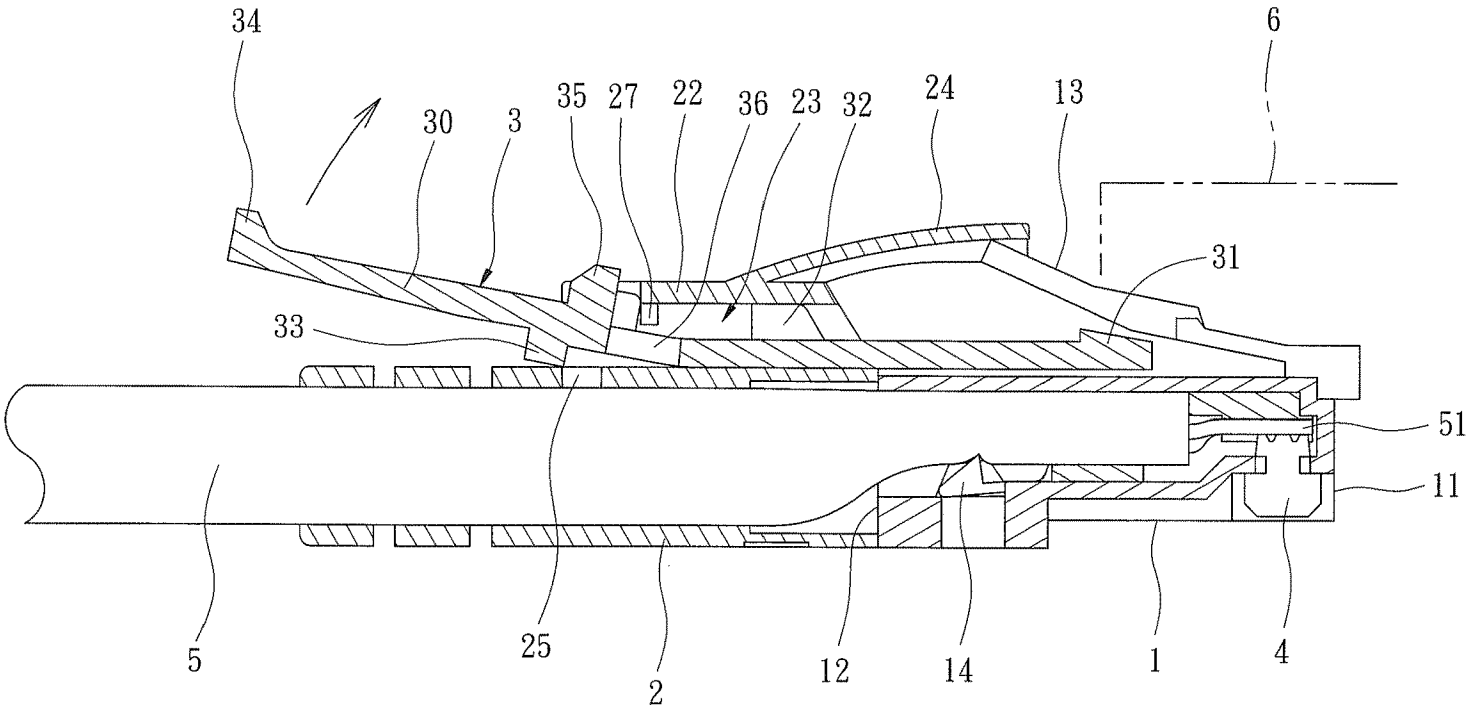
FIG. 8 is a diagrammatic cross sectional view illustrating upward bending of the stopper plate.
Figure 9:
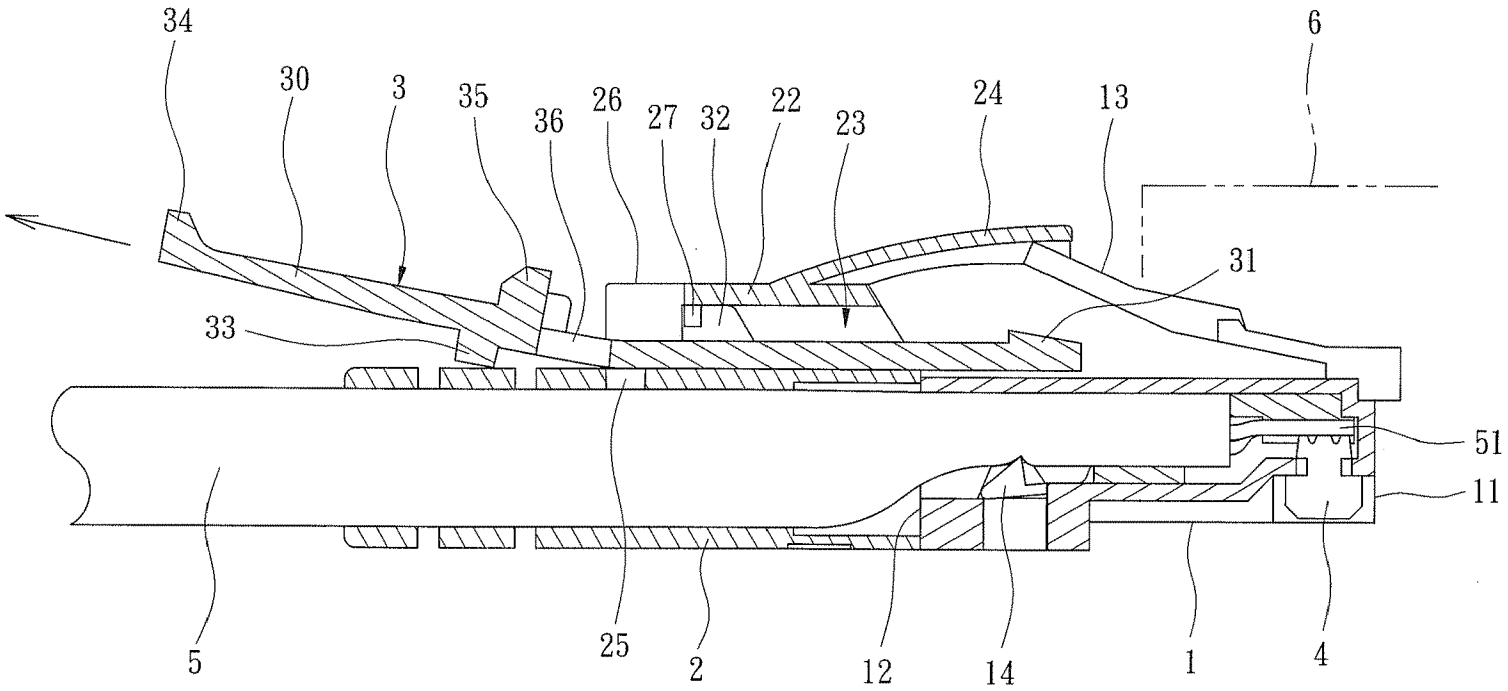
FIG. 9 is a diagrammatic cross sectional view illustrating movement of the stopper plate to an unlocking position.
Figure 10:
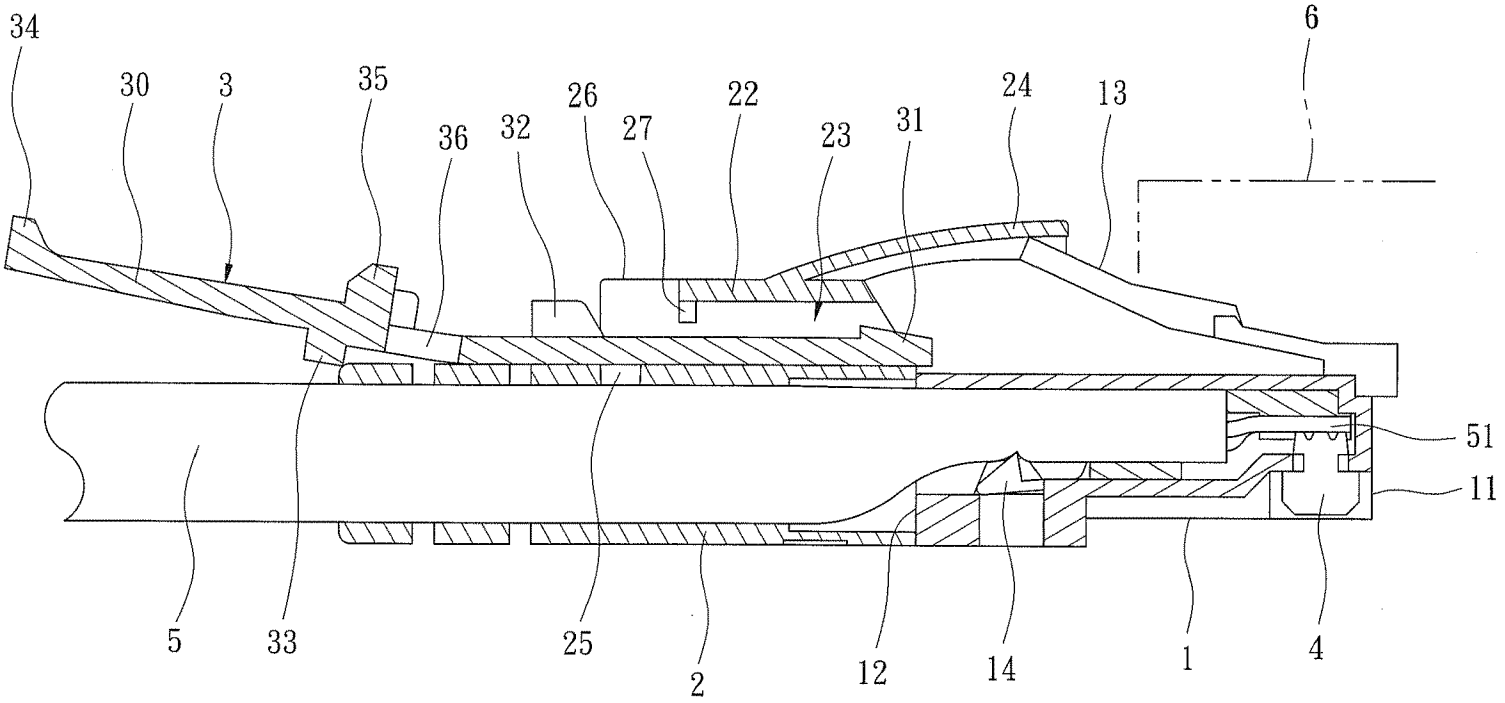
FIG. 10 is a diagrammatic cross sectional view illustrating the stopper plate in the unlocking position.

When it is desired to remove the network cable plug, as shown in FIG. 8, the operative portion 34 of the stopper plate 3 is bent upward at the slot 36 (a portion between the top protrusive portion 32 and the bottom protrusive portion 33) to disengage the bottom protrusive portion 33 from the fixing hole 25. Thus, the stopper plate 3 can be moved rearward to an unlocking position behind the locking position in the longitudinal direction. The stopper plate 3 in the unlocking position is disengaged from the elastic clip 13 of the plug body 1 (FIGS. 9 and 10). Thus, the unlocking operation is completely achieved without any tool. Thus, the network cable plug can be unlocked and removed more easily and more quickly.

Although specific embodiments have been illustrated and described, numerous modifications and variations are still possible without departing from the scope of the invention. The scope of the invention is limited by the accompanying claims.

The invention claimed is:

1. A network cable plug with a falling-off prevention structure, comprising:

a plug body including a front end and a rear end spaced from the front end in a longitudinal direction, wherein the plug body includes an insertion end at the front end thereof, wherein the insertion end is configured to be inserted into a network socket, wherein the insertion end includes an upper side, wherein an elastic clip projects from the upper side of the insertion end, and wherein the plug body further includes a connection end at the rear end thereof;

a connecting sleeve including a front end having a connecting portion, wherein the connecting portion is connected to the connection end of the plug body, wherein the connecting sleeve includes a shield disposed on a top side thereof, wherein the shield includes a receiving space extending from a front end through a rear end of the shield, wherein a fixing hole is defined in the top side of the connecting sleeve and intercommunicates with the receiving space; and a stopper plate including a plate body having a front end and a rear end, wherein the plate body includes a stopper portion on the front end thereof and an operative portion on the rear end thereof, wherein the plate body further includes a top protrusive portion disposed on a top side of the plate body and located between the stopper portion and the operative portion, wherein the plate body further includes a bottom protrusive portion disposed on a bottom side of the plate body and located between the top protrusive portion and the operative portion, wherein the stopper plate is inserted into the receiving space of the connecting sleeve and is movable between a locking position and an unlocking position behind the locking position in the longitudinal direction, with the stopper plate in the locking position, the stopper portion is located below and abuts the elastic clip to prevent the elastic clip from being pressed downward, the top protrusive portion is received in and abuts the shield, the bottom protrusive portion is engaged in the fixing hole, and the operative portion of the stopper plate is exposed behind the shield, and wherein the stopper plate is bendable upward at a portion between the top protrusive portion and the bottom protrusive portion to disengage the bottom protrusive portion from the fixing hole, permitting the stopper plate to move rearward to the unlocking position disengaged from the elastic clip of the plug body.

2. The network cable plug with the falling-off prevention structure as claimed in claim 1, wherein the shield of the connecting sleeve includes a positioning groove at the rear end of the receiving space, wherein the stopper plate further includes a positioning block disposed on the top side of the stopper plate and aligned with the bottom protrusive portion and wherein the positioning block is received in the positioning groove when the stopper plate is in the locking position.

3. The network cable plug with the falling-off prevention structure as claimed in claim 1, wherein the stopper plate further includes a slot in front of the positioning block.

* * * * *